US007025350B2

(12) United States Patent
Chen

(10) Patent No.: US 7,025,350 B2
(45) Date of Patent: Apr. 11, 2006

(54) STICK FOR A HOCKEY GAME TABLE

(75) Inventor: Ying-Tse Chen, Tainan Hsien (TW)

(73) Assignee: PAI LI Business Co., Ltd., (TW)

( * ) Notice: Subject to any disclaimer, the term of this patent is extended or adjusted under 35 U.S.C. 154(b) by 0 days.

(21) Appl. No.: 10/895,137

(22) Filed: Jul. 21, 2004

(65) Prior Publication Data

US 2006/0017223 A1 Jan. 26, 2006

(51) Int. Cl.
*A63F 7/00* (2006.01)
*A63F 9/24* (2006.01)

(52) U.S. Cl. ..... 273/126 R; 273/126 A; 273/129 L; 463/37

(58) Field of Classification Search ..... 463/37; 273/126 R, 126 A, 129 L, 129 R; 473/588; 220/740; D21/385
See application file for complete search history.

(56) References Cited

U.S. PATENT DOCUMENTS 2,225,241 A * 12/1940 Stearns ..... 273/129 R
3,734,504 A * 5/1973 Breslow ..... 273/126 R
3,887,187 A * 6/1975 Crossman et al. ..... 273/126 A
4,218,062 A * 8/1980 Brooks, Jr. ..... 273/108
5,284,343 A * 2/1994 Bigornia et al. ..... 473/446
5,467,985 A * 11/1995 Jones ..... 273/126 R
6,126,561 A * 10/2000 Mark ..... 473/588
2004/0164488 A1 * 8/2004 Fitzgerald ..... 273/108.1

* cited by examiner

*Primary Examiner*—Sebastiano Passaniti
(74) *Attorney, Agent, or Firm*—Bacon & Thomas PLLC

(57) ABSTRACT

A stick for a hockey game table includes an outer body and an inner body fitted in the outer body. The outer body has an open bottom, an annular stop wall facing downward on an inner surface near the bottom, an annular recessed surface on the inner surface, and two lateral holes in an inner surface of the annular wall. The inner body has an annular wall, an annular surface on the bottom outside around the annular wall. The annular wall and the annular surface of the inner body respectively fit with the annular stop wall and the annular recessed surface of the outer body when the inner body is combined in the outer body. The inner body further has two support bars on the inner surface of the annular wall, and a bead is fixed on an upper end of each support bar, possible to fit in the lateral holes of the outer body so as to secure stably the inner body with the outer body.

3 Claims, 7 Drawing Sheets

STICK FOR A HOCKEY GAME TABLE

BACKGROUND OF THE INVENTION

1. Field of the Invention

This invention relates to a stick for a hockey game table, particularly to one consisting of an inner body and an outer body of a simple structure so its cost may be lowered largely.

2. Description of the Prior Art

A conventional stick for a hockey game table generally has an outer body with an empty interior and an inner body fixed in the outer base on its bottom. But the inner and the outer base are combined together by means of screwing, which may result in a much work and high cost.

SUMMARY OF THE INVENTION

This invention has been devised to offer a stick for a hockey game table, which consists of an inner and an outer body easily combined to reduce its work and cost.

The feature of the invention is the outer body provided with an open bottom and two lateral holes in its annular wall at two opposite points, and the inner body positioned in the outer base and provided with two support bars extending upright at two opposite points to correspond to the lateral holes of the outer body. The upright support bars has a bead on the upper end, and the bead may fit in the lateral hole of the outer body with elastic expanding force to combine the inner body with the outer body easily and quickly without using screws.

BRIEF DESCRIPTION OF DRAWINGS

This invention will be better understood by referring to the accompanying drawings, wherein.

DETAILED DESCRIPTION OF DRAWINGS

Figure 1:
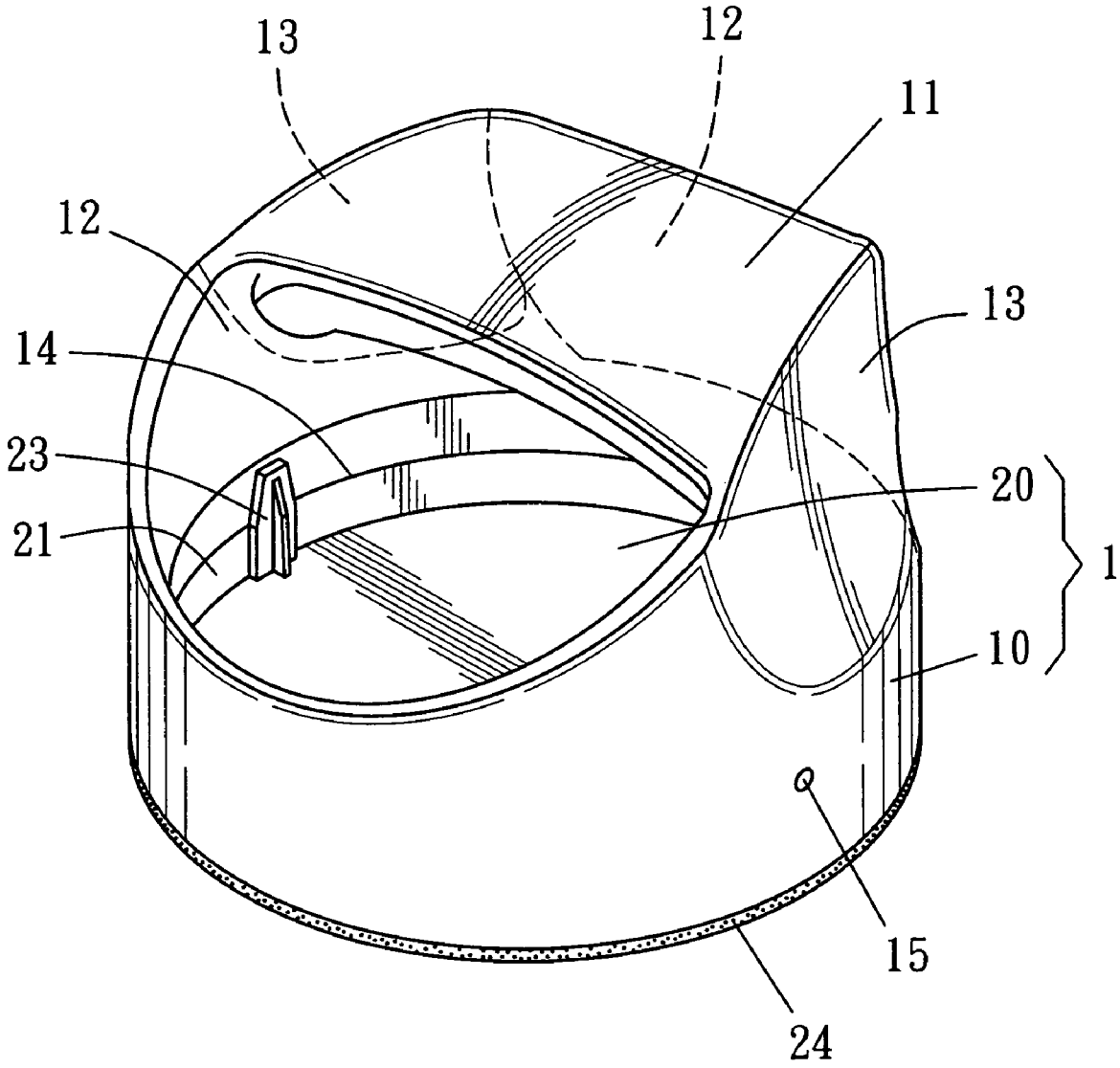
FIG. 1 is a perspective view of a first embodiment of a stick for a hockey game table in the present invention.
Figure 2:
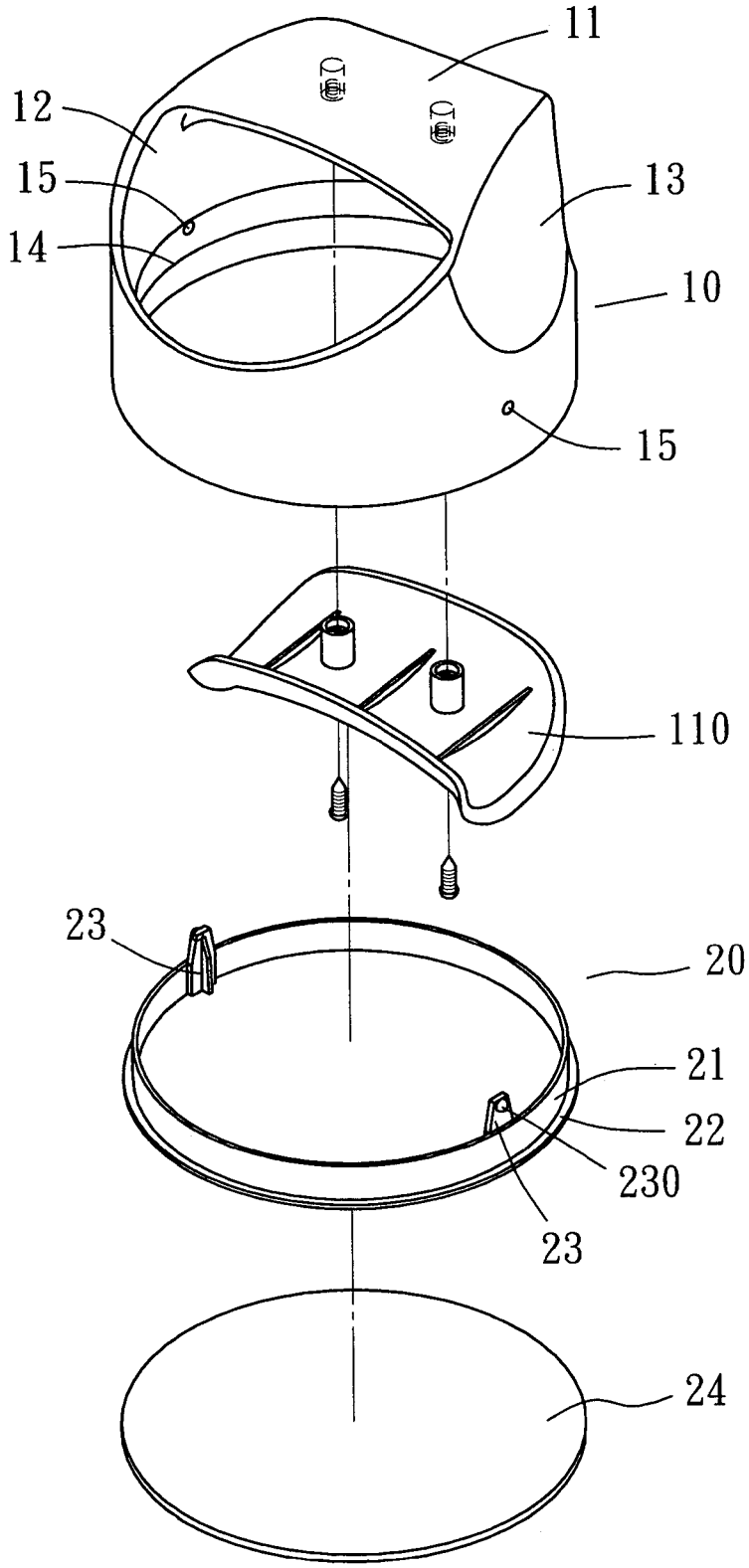
FIG. 2 is an exploded perspective view the first embodiment of a stick for a hockey game table in the present invention.

A preferred embodiment of a stick for a hockey game table in the present invention, as shown in FIGS. 1 and 2, includes an outer body 10 with an open bottom and an inner body 20 fitted in the interior of the outer body 10.

The outer body 10 is circular and cylindrical, having the open bottom, an empty interior, a grip surface 11 in the center section of an upper side, and an opening 12 at a front and a rear side of the grip surface 11. The openings 12 are for fingers of a user to extend therein for holding the lower portion of the grip surface 11, and a concave surface 13 is respectively provided at two sides of the grip surface 11 for the thumb of the user to rest on. Further, a bottom cap 110 is provided in the bottom of the grip surface 11 for holding comfortably the grip surface 11, as shown in FIG. 2. The outer body 10 further has an annular stop wall 14 facing downward on the inner wall near the bottom, and a lateral hole 15 formed at two opposite points on the annular wall above the annular stop wall 14. Further, a recessed surface 16 is formed on the inner wall near the bottom, extending outward.

Figure 4:
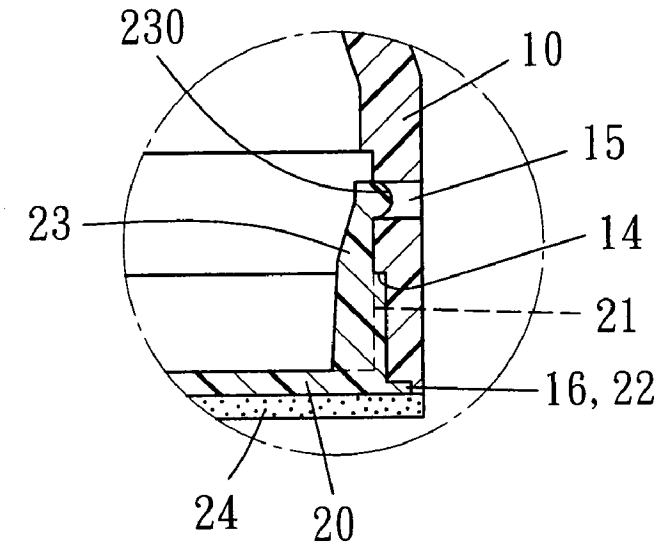
FIG. 4 is a partial exploded perspective view of the first embodiment of a stick for a hockey game table in the present invention.
Figure 3:
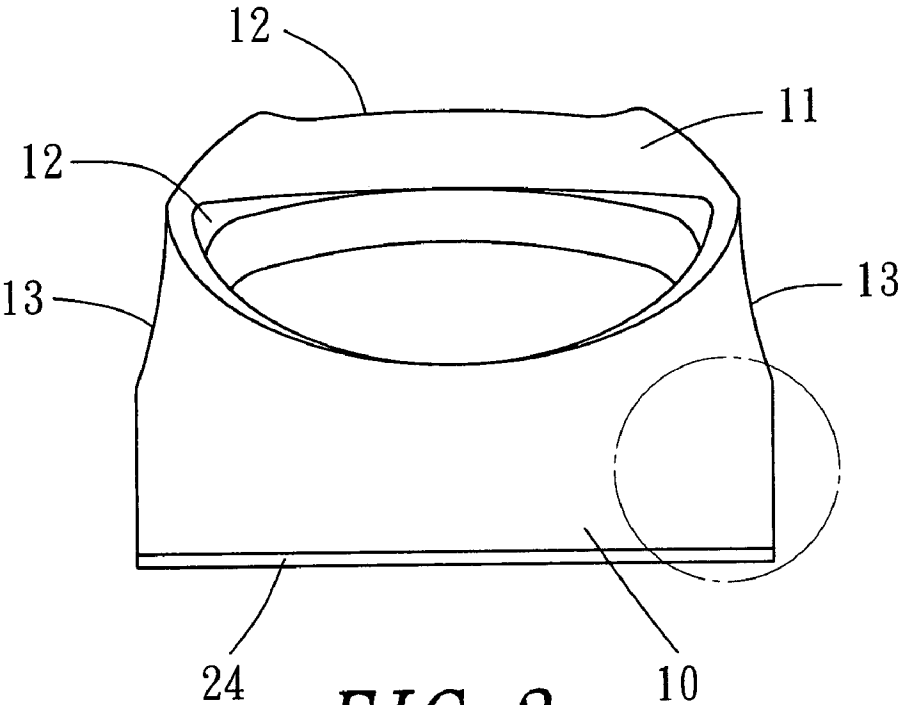
FIG. 3 is a front view of the first embodiment of a stick for a hockey game table in the present invention.

The inner body 20 is fitted in the interior of the outer body 10 near the bottom from under, having an annular wall 21, an annular surface 22 on the bottom outside along annular wall 21. When the inner body 20 is combined in the outer body 10, the upper end of the annular wall 21 pushes against the annular stop wall 14, with the annular surface 22 contacting with the recessed surface 16 of the outer body 10. Further, a support bar 23 is fixed upward respectively at two opposite points of the inner surface of the annular wall 21, as shown in FIGS. 2 and 4, and a bead 230 is fixed on the upper end of the support bar 23, possible to fit in the lateral holes 15 of the outer body 10 in case the inner body 20 is combined in the outer body 10. In addition, a cushion 24 enduring wear and tear is attached under the bottom of the inner body 20 for convenience of the stick in sliding and moving on a hockey game table.

In assembling the outer body 10 with the inner body 20, as shown in FIG. 1, the support bars 23 are aligned with the lateral holes 15, and the beads 230 are made to fit in the holes 15 by means of some elasticity, with the annular wall 21 and the annular surface 22 of the inner body 20 respectively fitting with the annular stop wall 14 and the recessed surface 16. After finishing assembly of the inner and the outer body 10 and 20, the stick 1 can be used to play the hockey game on the hockey game table. In playing, a user holds the grip surface 11 and moves the stick 1 on the table freely around. In using the stick 1 with some pressure in playing the hockey game, the combination of the inner body 20 and the outer body 10 is kept quite stable by means of the fitting tightness of the beads 230 with the holes 15 and the annular walls 21 and the annular surface 22 with the stop wall 14 and the recessed surface 16.

Figure 5:
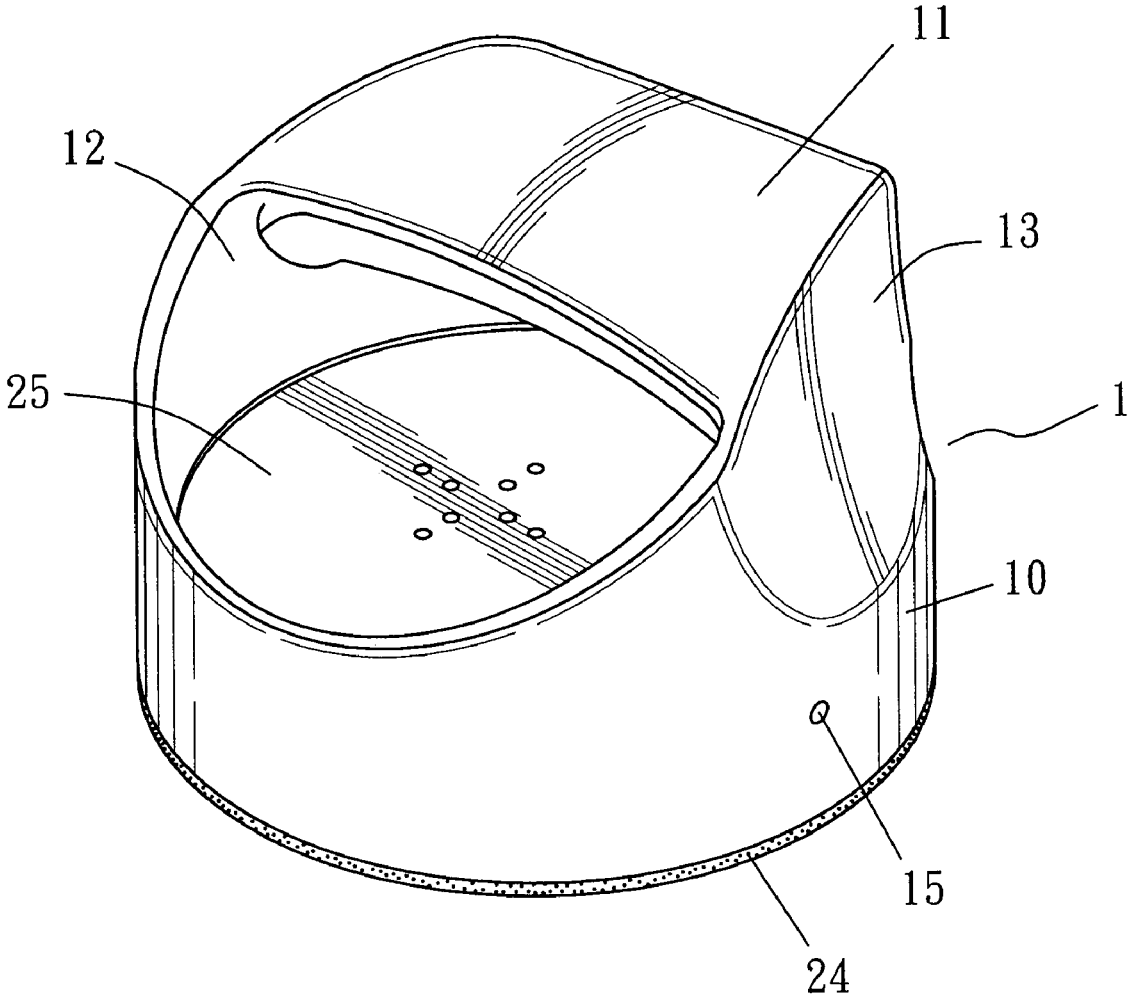
FIG. 5 is a perspective view of a second embodiment of a stick for a hockey game table in the present invention.
Figure 6:
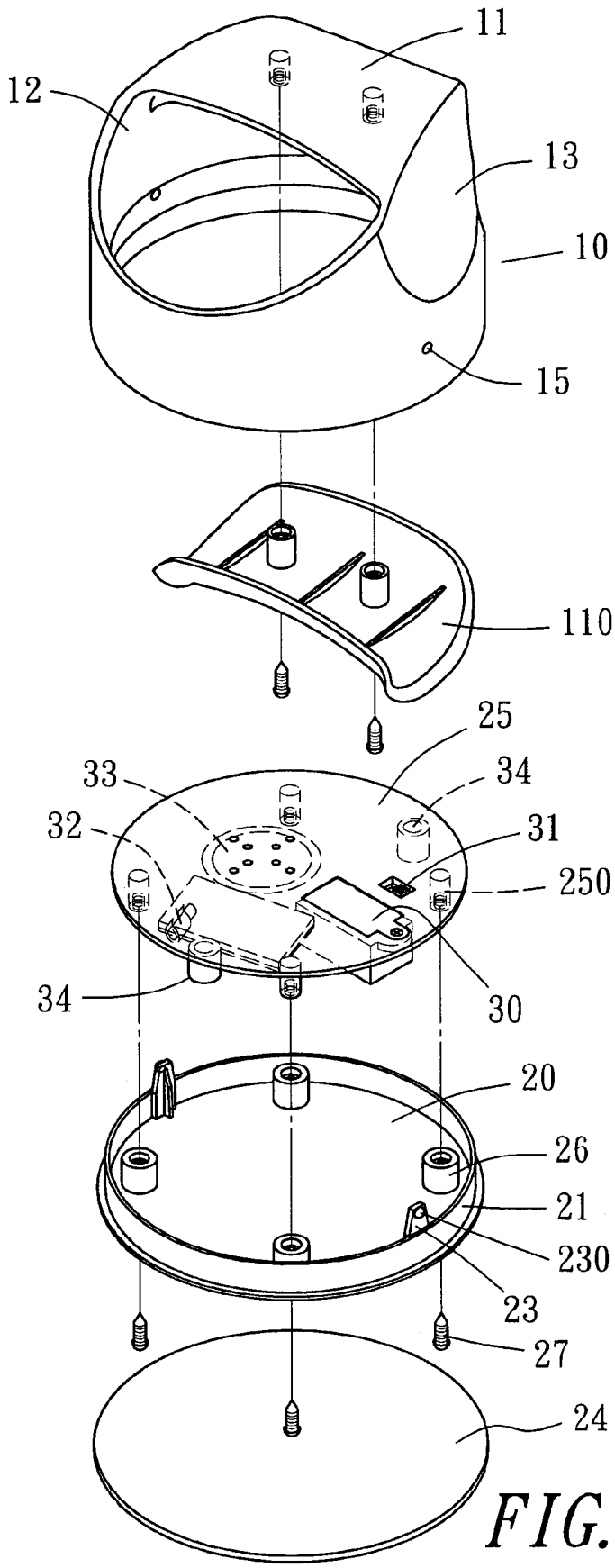
FIG. 6 is an exploded perspective view of the second embodiment of a stick for a hockey game table in the present invention.

Next, FIGS. 5 and 6 show a second embodiment of a stick for a hockey game table in the invention, which includes an inner and an outer body 20 and 10 as the same as the first embodiment, but an electric circuit board 25 with an electric circuit arranged thereon is additionally provided on the inner body 20 in the interior of the outer body 10. So when the stick 1 collides with a hockey ball, the electric circuit can give out flashing light and sound, adding sound and light effect for greatly elevating interest of the player. The inner body 20 is further provided with a center-holed post 26 respectively at two opposite points in the upper surface inside the annular wall 21, and the electric circuit board 25 is provided with a post 250 with a female-threaded hole respectively at opposite points corresponding to the center-holed posts 21. Then the electric circuit board 25 is secured stably on the inner body 20 with bolts engaging the posts 250 and the posts 26.

Figure 7:
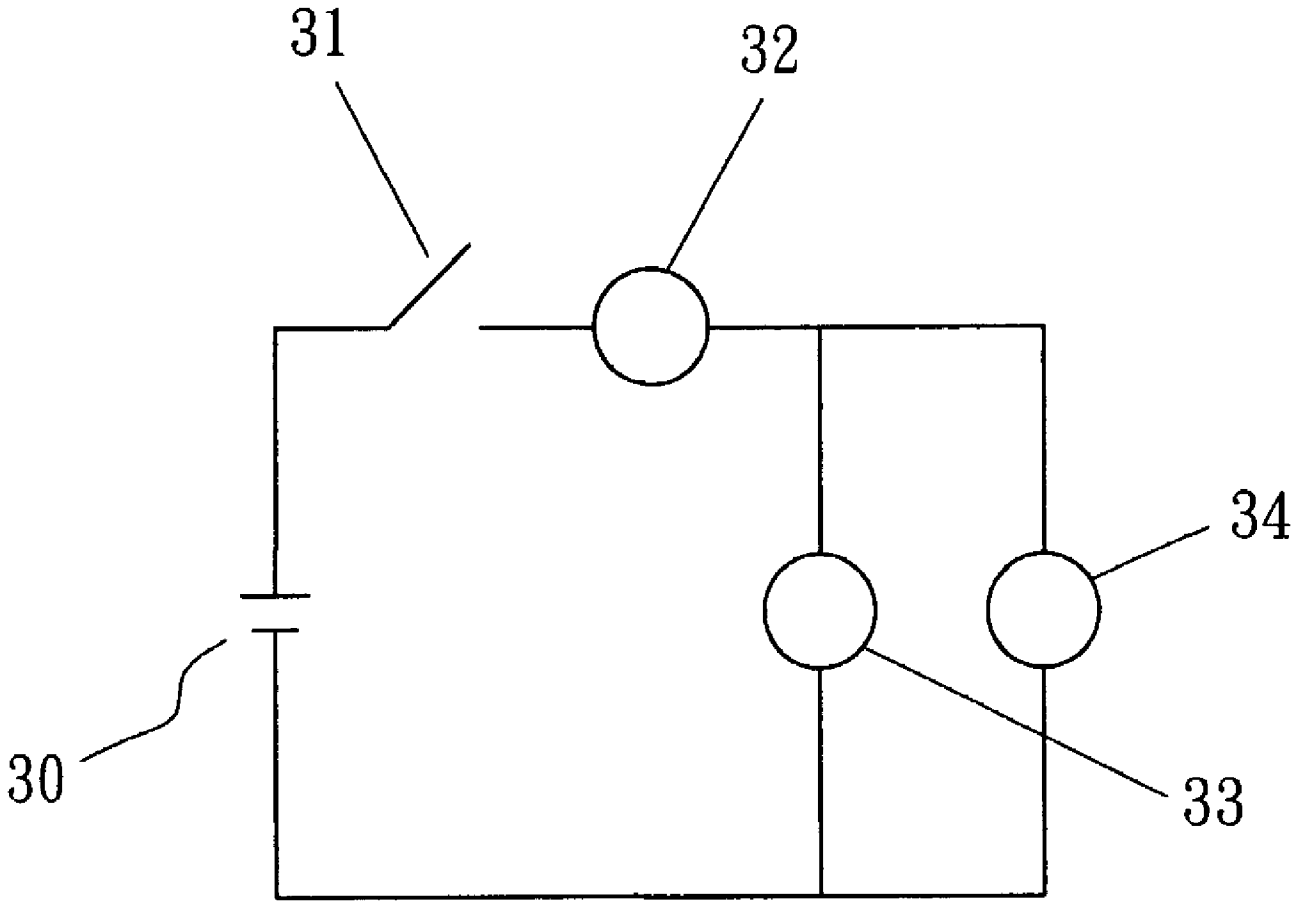
FIG. 7 is an electric circuit chart of the second embodiment of a stick for a hockey game table in the present invention; and, FIG. 8 is a perspective view of using the stick for a hockey game table in the present invention.
Figure 8:
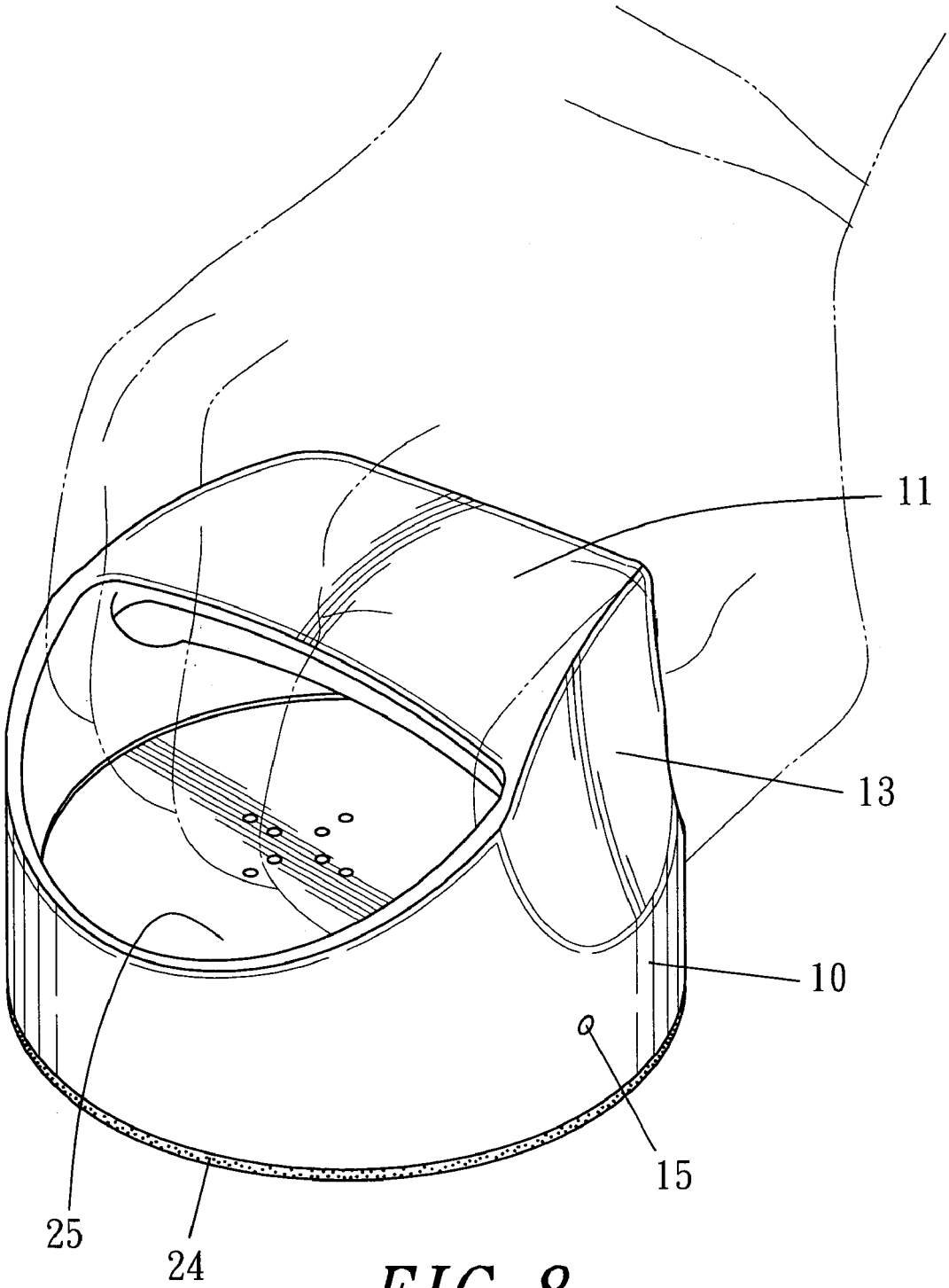

The electric circuit consists of a battery 30, a manual switch 31, a vibration switch 32, a buzzer 33 and a flash lamp 34 connected with one another in the way shown in FIG. 7. In playing, the manual switch 31 is turned on and continuously kept in the turn-on condition. A user holds the stick 1 as shown in FIG. 8, and moves it around for playing the hockey game. In case the stick 1 collides the hockey ball, the vibration switch 32 receives the colliding force and actuates the buzzer 33 and the flashing lamp 34 to turn on at once, adding sound and light to the play and upgrading interest of the player.

While the preferring embodiment of the invention has been descried above, it will be recognized and understood that various modifications may be made therein and the appended claims are intended to cover all such modifications that may fall within the spirit and scope of the inventin.

What is claimed is:

1. A stick for a hockey game table comprising an outer body with an open bottom and an inner body fitted in the empty interior of said outer body near its bottom; wherein said outer body is provided with an annular stop wall facing downward on an inner surface, an annular recessed surface on said inner surface near the bottom and extending outward, and a lateral hole respectively at two opposite points in the inner surface above said annular stop wall; and said inner body is provided with an annular wall extending upward to fit with the inner surface of said outer body, an annular surface formed on the bottom outside around said annular wall, said annular wall and said annular surface of said inner body fitting with said annular stop wall and said annular recessed surface of said outer body after said inner body is combined in said outer body, said inner body being further provided with an upright support bar respectively at two opposite points in an inner surface of said annular wall, a bead fixed on an upper end of each said support bar and fitted in said lateral holes of said outer body for securing said inner body with said outer body.

2. The stick for a hockey game table as claimed in claim 1, wherein an electric circuit board is further fixed on said inner body in the interior of said outer body, an electric circuit arranged on said electric circuit board and consisting of a manual switch, vibration switch, a battery, a buzzer and a flash lamp, wherein said buzzer and said flash lamp are turned on to function to sound out and light up on-and-off when said stick moves and collides with a hockey ball, with said manual switch kept in an on condition.

3. The stick for a hockey game table as claimed in claim 1, wherein said outer body is further provided with a grip surface formed in a center section of an upper side, an opening formed at a front and a rear side of said grip surface, and a concave formed respectively at two sides of said grip surface for the thumb of a user to rest thereon.

* * * * *